US006369681B1

(12) United States Patent
Lin

(10) Patent No.: US 6,369,681 B1
(45) Date of Patent: Apr. 9, 2002

(54) MINI TRANSFORMER

(75) Inventor: Rex Lin, Hsin-Tien (TW)

(73) Assignee: Ming-chu Tan, Taipei (TW)

( * ) Notice: Subject to any disclaimer, the term of this patent is extended or adjusted under 35 U.S.C. 154(b) by 0 days.

(21) Appl. No.: 09/628,243

(22) Filed: Jul. 28, 2000

(51) Int. Cl.[7] ..... H01F 27/29; H01F 27/24

(52) U.S. Cl. ..... 336/192; 336/233; 336/198; 336/208

(58) Field of Search ..... 336/198, 233, 336/208

(56) References Cited

U.S. PATENT DOCUMENTS 4,760,366 A * 7/1988 Mitsui ..... 336/233
5,315,280 A * 5/1994 Stokes et al. ..... 336/192
5,977,855 A * 11/1999 Matsumura et al. ..... 336/96
6,072,380 A * 6/2000 Monroe ..... 336/198
6,078,240 A * 6/2000 Huang ..... 336/90

* cited by examiner

*Primary Examiner*—Anh Mai

(57) ABSTRACT

A mini transformer comprises a coil, a core, and pins with one ends embedded in plastic pegs at primary winding and plastic pegs at secondary winding respectively. Plastic pegs are provided at the bottom of core. Conductors are electrically connected between pins and coil by soldering. Insulated flanges are provided on both sides of core at the junctions between plastic pegs and core. This can increase the electrical paths from pins to core. Further, it complies with insulation regulations.

1 Claim, 2 Drawing Sheets

MINI TRANSFORMER

FIELD OF THE INVENTION

The present invention relates to a mini transformer with improved insulation feature.

BACKGROUND OF THE INVENTION

There is trend to minimize the size of a product in modern days. This is true particularly to electrical/electronic products. A conventional mini transformer commercially available for fulfilling such needs is shown in FIG. 1. The mini transformer comprises a coil 10, a core 11, and a plurality of pins 14 and 15 with one ends embedded in a plurality of plastic pegs 12 at primary winding and a plurality of plastic pegs 13 at secondary winding respectively. Plastic pegs 12 and 13 are provided at the bottom of core 11. A plurality of conductors 101 are electrically connected between pins 14 and coil 10, while a plurality of conductors 102 are electrically connected between pins 15 and coil 10 wherein conductors 101 and 102 are soldered to coil 10. One can connect a desired electrical device between a conductor 101 and a conductor 102 when using the transformer. But this is unsatisfactory for the purpose for which the present invention is concerned for the reason of poor insulation caused by its mini size.

A mini transformer aimed at eliminating above problem is shown in FIG. 2. The improvement is that an elongate groove 121 is provided across the upper portions of plastic pegs at either side. These grooves 121 can increase the electrical paths from pins 14 and 15 to core 11 respectively, resulting in an increase of insulation. But this design suffered from a drawback, i.e., a structural destruction of the pins 14 and 15. Further, the increase of insulation is limited. To the worse, neither of above designs complies with insulation regulations. Thus improvement still exists.

SUMMARY OF THE INVENTION

It is therefore an object of the present invention to provide a mini transformer mounted in an electrical device comprising a coil, a core, and a plurality of pins with one ends embedded in a plurality of plastic pegs at primary winding and a plurality of plastic pegs at secondary winding respectively. Plastic pegs are provided at the bottom of core. Conductors are electrically connected between pins and coil by soldering. Insulated flanges are provided on both sides of core at the junctions between plastic pegs and core. This can increase the electrical paths from pins to core without damaging the structures of plastic pegs. Also, it does not increase the height of transformer. Further, the total width of this mini transformer after the increase of the extended widths of insulated flanges is still within the allowable range of the original mini transformer. Thus no modification to the corresponding electrical device is required. Most importantly, it complies with insulation regulations.

The above and other objects, features and advantages of the present invention will become apparent from the following detailed description taken with the accompanying drawings.

DETAILED DESCRIPTION OF PREFERRED EMBODIMENTS

Figure 1:
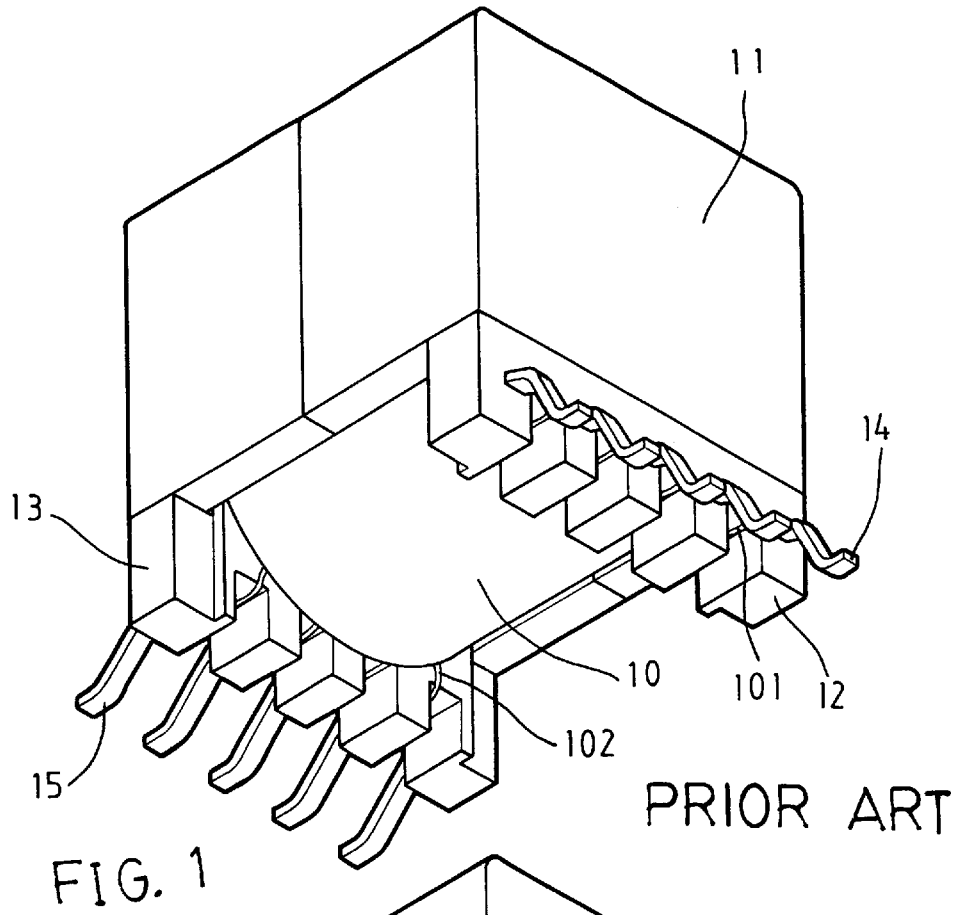
FIG. 1 is a perspective view of a conventional mini transformer.
Figure 2:
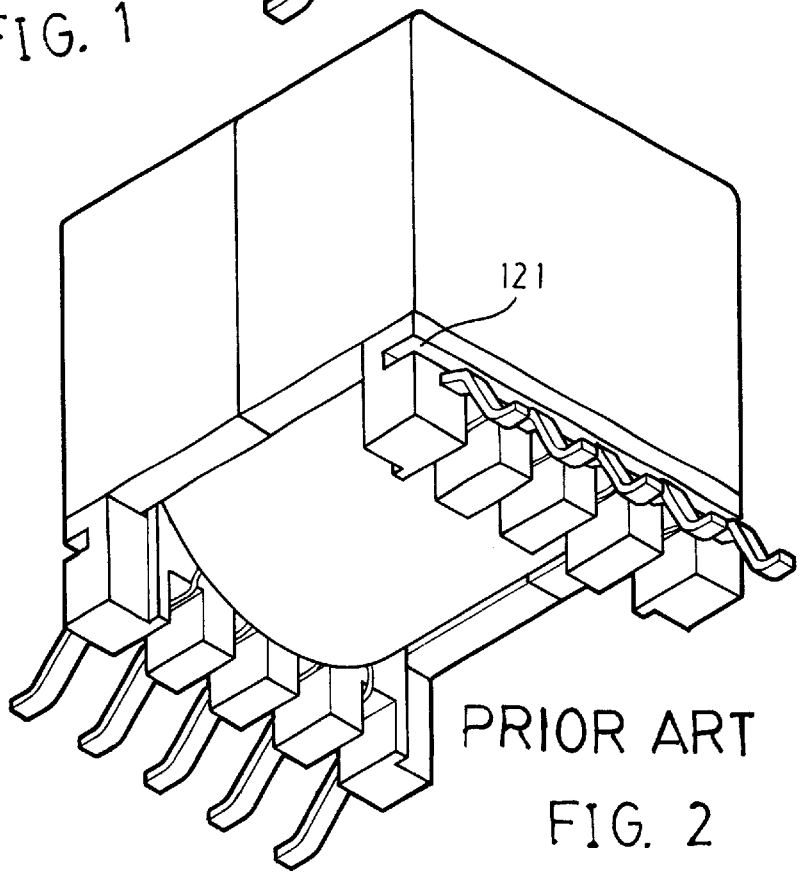
FIG. 2 is a perspective view of another conventional mini transformer.
Figure 3:
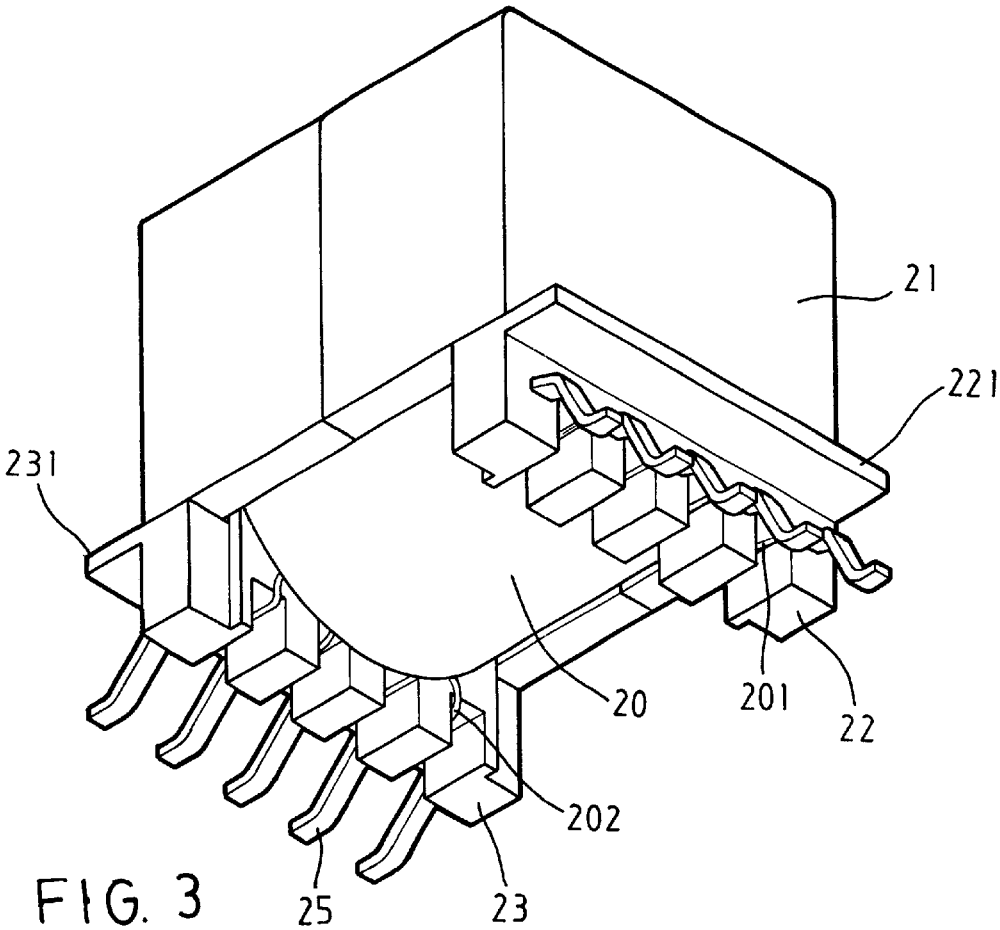
FIG. 3 is a perspective view of a mini transformer according to the invention.
Figure 4:
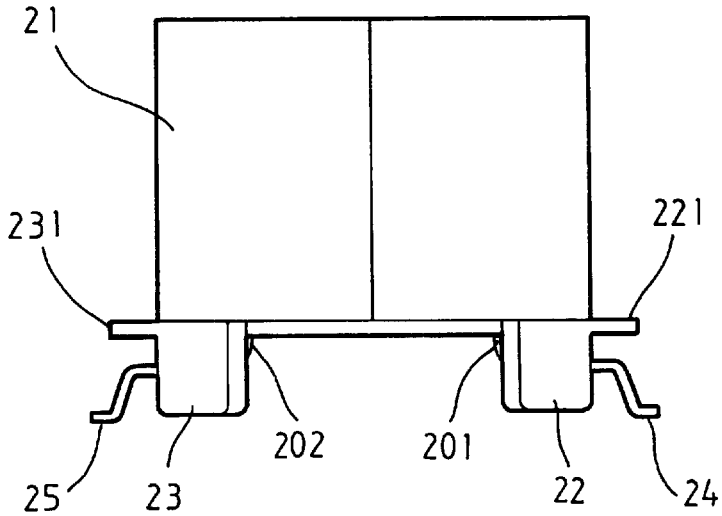
FIG. 4 is a side view of FIG. 3.

Referring to FIGS. 3 and 4, there is shown a mini transformer constructed in accordance with the present invention comprising a coil 20, a core 21, and a plurality of pins 24 and 25 with one ends embedded in a plurality of plastic pegs 22 at primary winding and a plurality of plastic pegs 23 at secondary winding respectively. Plastic pegs 22 and 23 are provided at the bottom of core 11. A plurality of conductors 201 are electrically connected between pins 24 and coil 20, while a plurality of conductors 202 are electrically connected between pins 25 and coil 10 wherein conductors 201 and 202 are soldered to coil 10. One can connect a desired electrical device between a conductor 201 and a conductor 202 when using the transformer.

The improvement of the invention is that insulated flanges 221 and 231 are provided on both sides of core 21 at the junctions of plastic pegs 22 and 23 with core 21 respectively. This can increase the electrical paths from pins 24 and 25 to core 21 respectively without damaging the structures of plastic pegs 22 and 23. Such design does not increase the height of transformer. Further, the total width of this mini transformer after the increase of the extended widths of insulated flanges 221 and 231 is still within the allowable range of the original mini transformer. Thus no modification to the corresponding electrical device is required. Most importantly, it complies with insulation regulations.

While the invention has been described by means of specific embodiments, numerous modifications and variations could be made thereto by those skilled in the art without departing from the scope of the invention set forth in the claims.

What is claimed is:

1. A mini transformer comprising:

a coil;

a core;

a primary winding;

a plurality of plastic pegs at the primary winding under the core;

a secondary winding;

a plurality of plastic pegs at the secondary winding under the core;

a plurality of first pins with one ends embedded in the plastic pegs at the primary winding;

a plurality of second pins with one ends embedded in the plastic pegs at secondary winding; and a pair opposite insulated flanges provided at the junctions between the plastic pegs at the primary winding and the core and between the plastic pegs at the secondary winding and the core respectively whereby the electrical path from the first pins to the core and the electrical path from the second pins to the core are increased.

* * * * *